US008026869B2

(12) United States Patent
Takagi et al.

(10) Patent No.: US 8,026,869 B2
(45) Date of Patent: Sep. 27, 2011

(54) PLASMA DISPLAY DRIVING METHOD AND APPARATUS

(75) Inventors: Akihiro Takagi, Miyazaki (JP); Takashi Sasaki, Miyazaki (JP); Akira Otsuka, Miyazaki (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 998 days.

(21) Appl. No.: 11/913,201

(22) PCT Filed: Jun. 20, 2005

(86) PCT No.: PCT/JP2005/011272

§ 371 (c)(1),
(2), (4) Date: Oct. 31, 2007

(87) PCT Pub. No.: WO2006/137118

PCT Pub. Date: Dec. 28, 2006

(65) Prior Publication Data

US 2009/0079726 A1 Mar. 26, 2009

(51) Int. Cl.
*G09G 3/28* (2006.01)

(52) U.S. Cl. ..... 345/60; 345/69; 345/70

(58) Field of Classification Search ..... 345/60–72, 345/214

See application file for complete search history.

(56) References Cited

U.S. PATENT DOCUMENTS

| | | | | |
|---|---|---|---|---|
| 5,663,741 | A | 9/1997 | Kanazawa | |
| 6,236,165 | B1 | 5/2001 | Ishizuka | |
| 6,483,251 | B2 | 11/2002 | Setoguchi et al. | |
| 2002/0167466 | A1 | 11/2002 | Setoguchi et al. | |
| 2004/0021656 | A1 * | 2/2004 | Kang et al. | 345/204 |
| 2004/0104869 | A1 * | 6/2004 | Jeong | 345/60 |
| 2005/0068262 | A1 * | 3/2005 | Mizobata et al. | 345/60 |

FOREIGN PATENT DOCUMENTS

| | | |
|---|---|---|
| JP | 06-314078 | 11/1994 |
| JP | 2000-75835 | 3/2000 |
| JP | 2000-214822 | 8/2000 |
| JP | 2000-227780 | 8/2000 |
| JP | 2001-013910 | 1/2001 |
| JP | 2002-207449 | 7/2002 |
| JP | 2003-140601 | 5/2003 |
| JP | 2004-226792 | 8/2004 |
| JP | 2005-077744 | 3/2005 |
| KR | 20020027173 | 4/2002 |
| KR | 1020030088536 | 11/2003 |
| KR | 1020040078399 | 9/2004 |

* cited by examiner

*Primary Examiner* — Amare Mengistu
*Assistant Examiner* — Koosha Sharifi-Tafreshi
(74) *Attorney, Agent, or Firm* — Antonelli, Terry, Stout & Kraus, LLP.

(57) ABSTRACT

A plasma display driving method and apparatus that can reduce the occurrences of dropout, on a displayed image, caused by misaddress when the environment temperature becomes low. In the inventive plasma display, the environment temperature is determined, and during a charge adjustment interval, the ultimate voltage, which the drive waveform of a scan electrode voltage reaches at the end after continuously varying in the negative direction, is changed in accordance with the determined environment temperature in such a manner that if the environment temperature becomes lower, the ultimate voltage is directed in the positive direction.

5 Claims, 15 Drawing Sheets

FIG.4
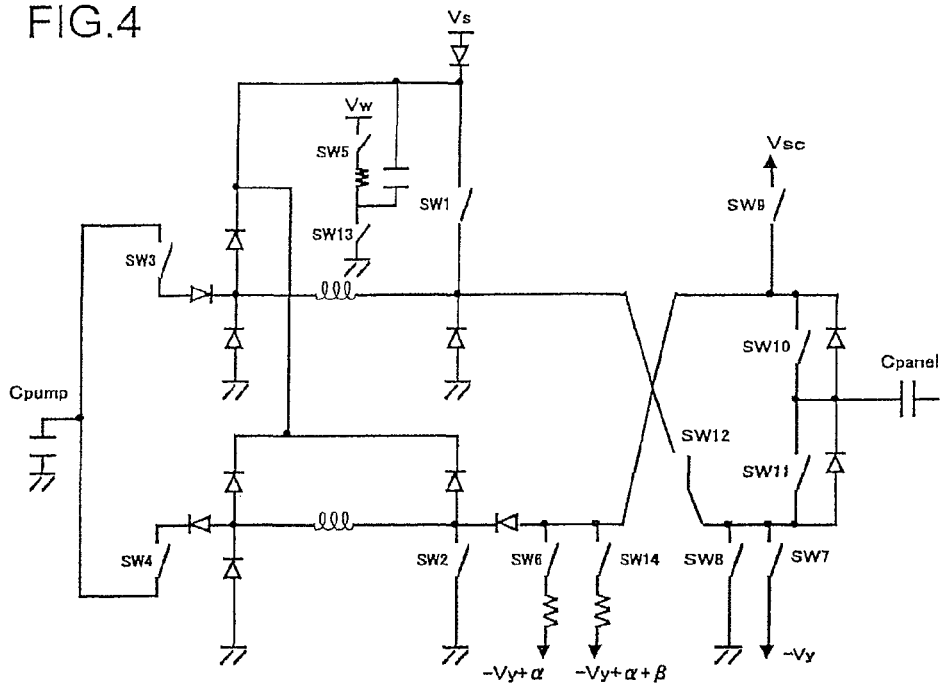
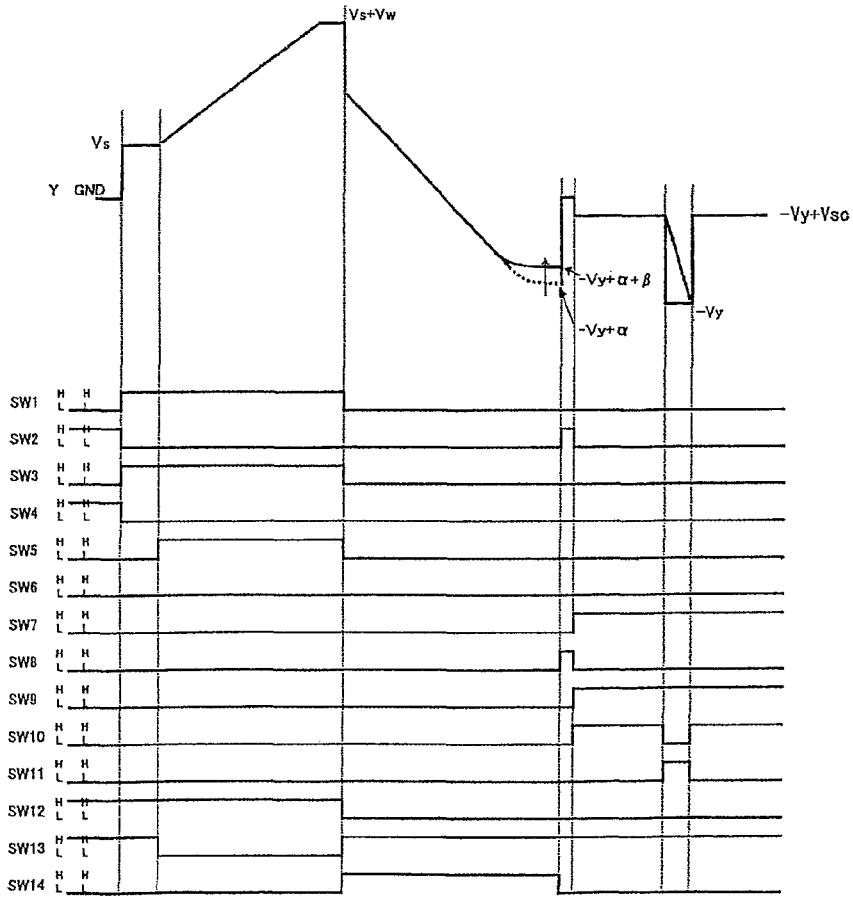

FIG.6
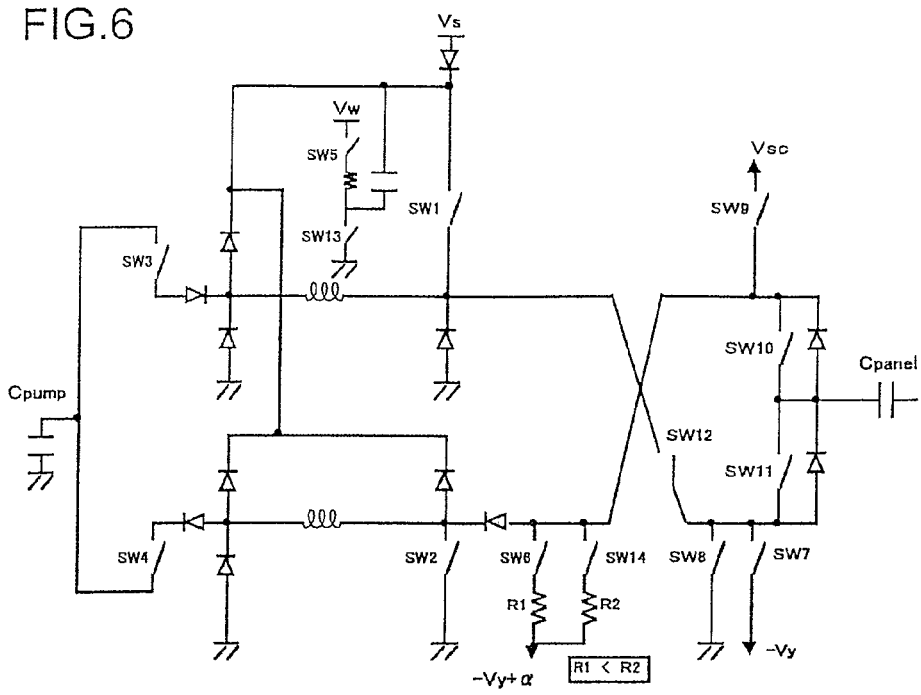
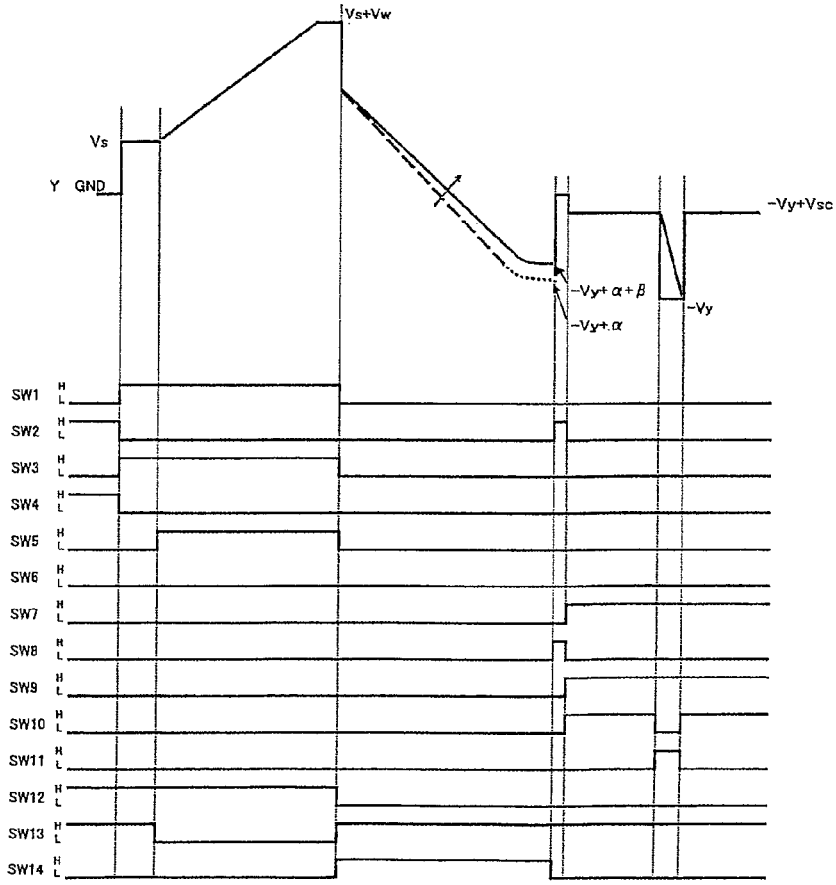

PRIOR ART
FIG.10 【STRUCTURE OF PLASMA DISPLAY PANEL 】
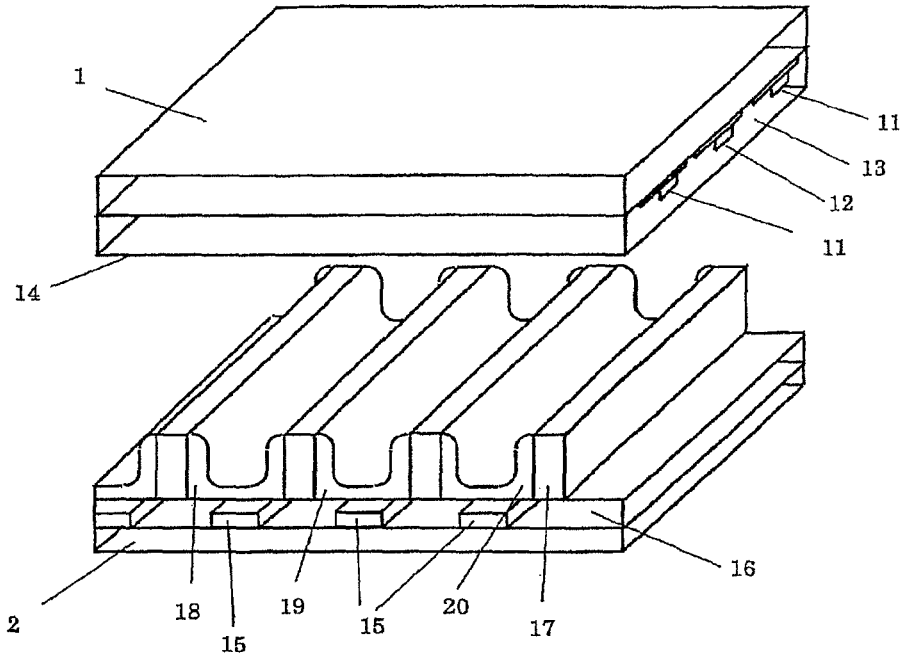
【SUBFIELD CONFIGURATION OF DRIVING SIGNAL】
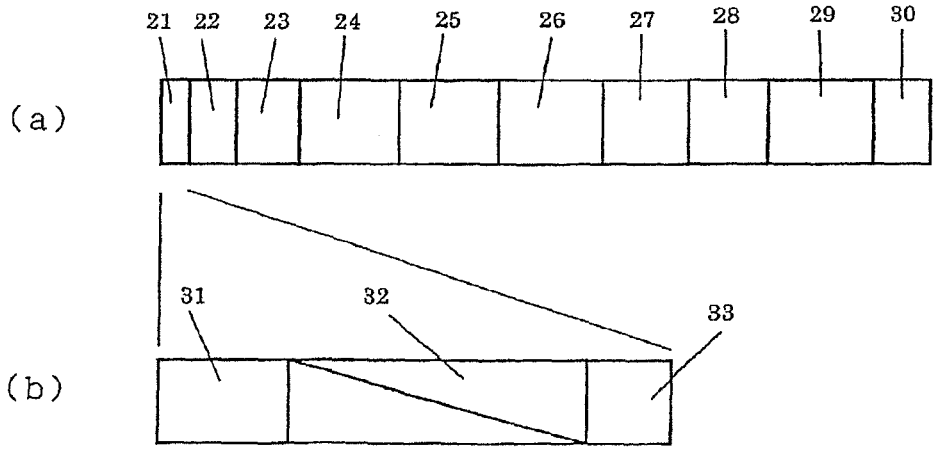

PRIOR ART
FIG.13
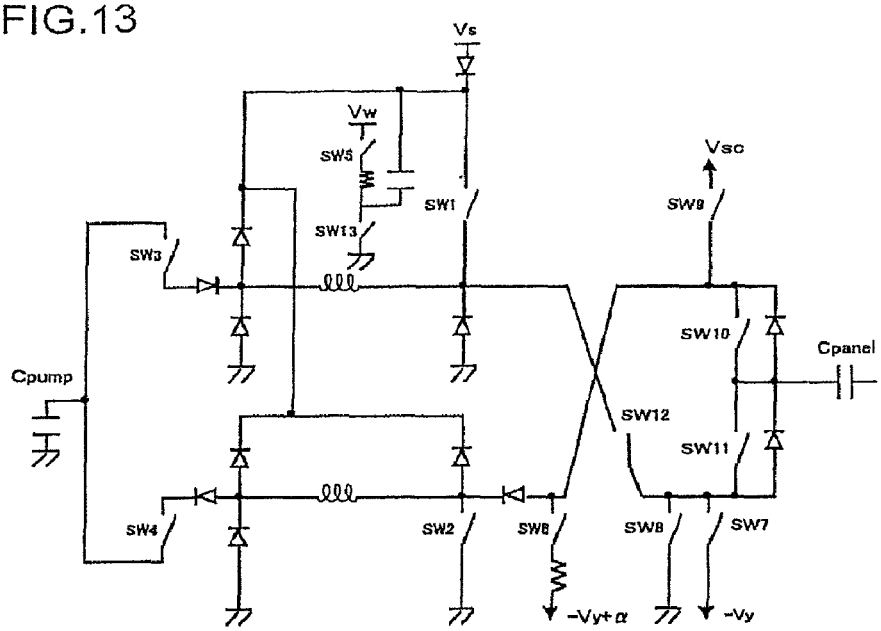
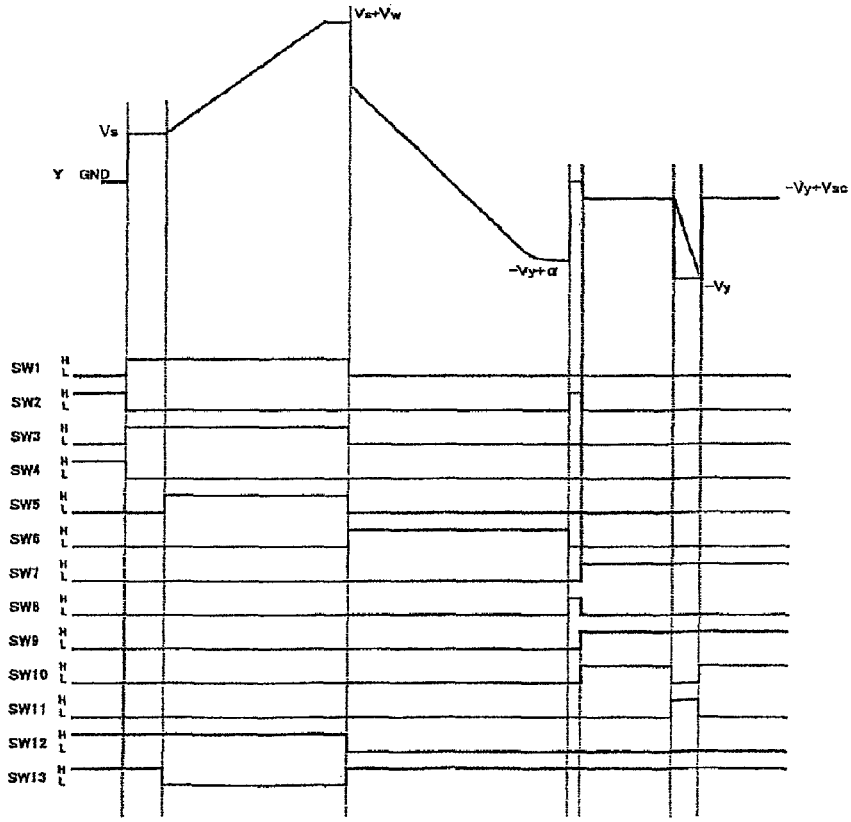

PRIOR ART
FIG.14
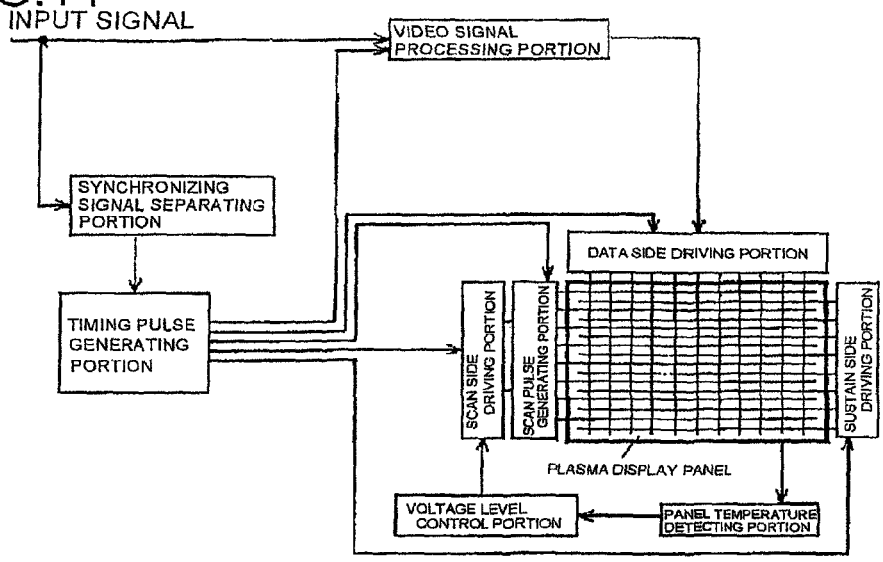
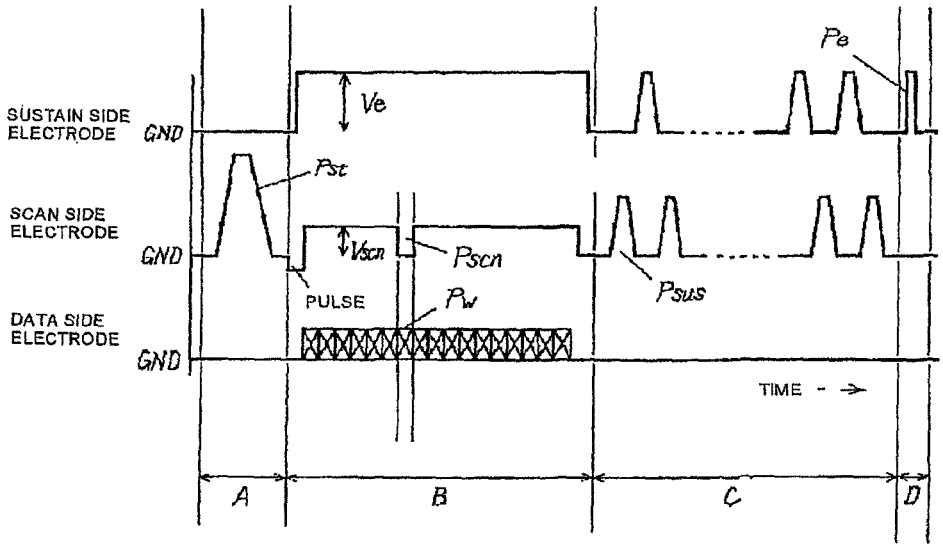

PLASMA DISPLAY DRIVING METHOD AND APPARATUS

TECHNICAL FIELD

The present invention relates to a plasma display driving method and device. To be more precise, preferred embodiments of the present invention provide a plasma display driving method and device which can reduce generation of noise on a plasma display screen caused by misaddress when environment temperature of the plasma display becomes low.

BACKGROUND ART

Conventionally, in the technical field of a plasma display device, there is a known device of a method wherein multiple X electrodes and multiple Y electrodes are mutually adjacently placed in a horizontal direction and address electrodes are placed in a vertical direction to form a matrix so that an image is displayed by applying drive waveforms from an X driving circuit, a Y driving circuit and an address driving circuit to a discharge cell at an intersection of the electrodes.

FIG. 9 shows a schematic diagram of a panel and driving circuits of a conventional plasma display device. FIG. 10 show a structure of a plasma display panel and a subfield configuration of a driving signal.

With reference to FIG. 9, the plasma display device is composed of a plasma display panel 3, an X driving circuit 4, a Y driving circuit 5, an address driving circuit 6 and a control circuit 7.

The X driving circuit 4 applies a drive waveform to multiple X electrodes 11 of the panel 3. The Y driving circuit 5 applies a drive waveform to multiple Y electrodes 12 of the panel 3. The address driving circuit 6 applies a drive waveform to multiple address electrodes 15 of the panel 3. The control circuit 7 controls the entirety.

According to the panel structure of the plasma display described in FIG. 10, the multiple X electrodes 11 and Y electrodes 12, a dielectric layer 13 and a protective layer 14 are placed on the surface of a front plate 1. In addition, the multiple address electrodes 15, a dielectric layer 16, a bulkhead 17 and phosphors 18 to 20 which are orthogonal to the X electrodes 11 and Y electrodes 12 are placed on the surface of a backplane 2. A gas which is a discharge gas is encapsulated in space inside a cell, where a voltage applied to each of the electrodes is controlled so as to discharge electricity by putting the gas in an excited state. The phosphors 18 to 20 convert ultraviolet generated by the discharge to visible light.

The subfield configuration diagram of the driving signal described in FIG. 10 (*a*) shows the configuration of subfields 21 to 30 having 10 fields. FIG. 10 (*b*) describes that a reset interval 31, an address interval 32 and a sustain interval 33 are provided in one subfield.

FIG. 11 shows the drive waveforms in the case of resetting all the cells in a write interval within the reset interval of a conventional plasma display panel.

FIG. 11 shows examples of the drive waveforms wherein, as shown in FIGS. 10 (*a*) and (*b*) for instance, a field section is divided into multiple subfields, and the subfield is divided into the reset interval, address interval and sustain interval while the reset interval is further divided into the write interval and a charge adjustment interval, and the address interval is divided into an first half address interval and a second half address interval.

As for the drive waveforms in the case of resetting all the cells shown in FIG. 11, a driving voltage applied to the Y electrode increases (changes in a positive direction) from a voltage Vs in the write interval of the reset interval, and the driving voltage applied to the Y electrode decreases (changes in a negative direction) in the charge adjustment interval so as to reach a certain ultimate voltage ($-Vy+\alpha$).

FIG. 12 shows the drive waveforms in the case of resetting only the cells lit up in the write interval of the reset interval of the conventional plasma display panel.

As for the drive waveforms in the case of resetting only the lit up cells in FIG. 12, the driving voltage applied to the Y electrode is maintained at a fixed value 2Vs in the write interval of the reset interval, and the driving voltage applied to the Y electrode decreases (changes in the negative direction) in the charge adjustment interval so as to reach a certain ultimate voltage ($-Vy+\alpha$).

FIG. 13 are diagrams showing the Y driving circuit of the conventional plasma display panel and timing between the drive waveform applied to the Y electrode and switching of each individual switch.

The Y driving circuit of FIG. 13 includes positive constant voltages Vs, Vw and negative constant voltages ($-Vy+\alpha$), ($-Vy$), and is composed of multiple diodes, multiple inductances L, multiple capacitances C, multiple resistances R and multiple switches SW 1 to SW 13. The Y driving circuit controls the timing of switching (on/off: H, L) of the multiple switches SW 1 to SW 13 so as to apply the drive waveform of the Y electrode to a panel Cpanel.

As for the drive waveform applied to the Y electrode, as shown in FIG. 11, the voltage rises in the first half of the reset interval to reach Vs+Vw, and the voltage lowers in the second half of the reset interval to reach $-Vy+\alpha$. And a pulse voltage of $-Vy$ is applied to the Y electrode in the address interval. Concurrently with applying the pulse voltage of $-Vy$ to the Y electrode, the pulse voltage of +Va is applied to the address electrode so that the electrical discharge is started between the address electrode and the Y electrode, and the electrical discharge is further performed between the X electrode and the Y electrode so as to address the cells that light up. After that, in the sustain interval, the opposite pulse voltage Vs is alternately applied between the X electrode and the Y electrode so as to continue a sustained discharge.

The following Patent Document 1 discloses a plasma display driving method wherein, in the case where panel temperature rises or the panel lights up for a long time, a pulse for reducing a wall voltage is applied to a scan side electrode immediately before applying a base voltage so as to reduce an electric potential of the scan side electrode for the purpose of curbing deterioration of a display lighting state in the case where the panel temperature rises or the panel lights up for a long time.

FIG. 14 show a schematic diagram of the panel and driving circuit of the plasma display device and the drive waveform applied to each of the electrodes according to Patent Document 1.

In FIG. 14, a panel temperature detection portion detects the panel temperature of the plasma display panel. In the case where panel temperature rises, or the like, the panel temperature detection portion applies a pulse of a negative voltage for lowering the electric potential of the scan side electrode to the scan side electrode immediately before applying a base voltage Vscn so as to prevent the deterioration of the display lighting state in the case where the panel temperature rises or the panel lights up for a long time.

The deterioration of the display lighting state is caused due to unnecessary electrical discharge generated by molecules excited by slightly emitted electrons when a protection film of the panel is sputtered by the electrical discharge during the lighting and impurities in the protection film are emitted in the gas to increase the molecules in the gas in the case where the impurities in the phosphors gasify due to the rise in the panel temperature and increase the molecules in the gas or in the case where the panel is lit up for a long time.

The pulse applies the negative voltage to the scan side electrode for a short period of time immediately before applying the base voltage Vscn and reduces the wall voltage so as to prevent the deterioration.

Patent Document 1: Japanese Patent Laid-Open Publication No. 2003-140601

FIG. 15 show the drive waveform applied to the Y electrode of the conventional plasma display panel and a problem arising in the case of low environment temperature.

In FIG. 15, if there is a rise in the voltage of the drive waveform applied to the Y electrode in the write interval within the reset interval, negative charges accumulate in proximity to the Y electrode in the panel while positive charges accumulate in proximity to the address electrode and the X electrode. The accumulated negative charges and positive charges gradually decrease in the charge adjustment interval. At the time point of a certain ultimate voltage at the end of the charge adjustment interval, the negative charges are accumulated in proximity to the Y electrode in the panel while the positive charges are accumulated in proximity to the address electrode and the X electrode (referred to as "wall charges").

In the address interval after the reset interval, a positive voltage Va is applied to the address electrode, and a negative voltage −Vy is simultaneously applied to the Y electrode. In the cell where the address electrode intersects with the Y electrode, a potential difference (Va+Vy) between the positive voltage Va and the negative voltage −Vy in the address interval is overlapped in the same direction as the electric potential (wall potential) from the address electrode to the Y electrode due to the wall charges so that the electrical discharge is started. However, there has been a problem that, if the environment temperature of the plasma display becomes low, such as an initial state of power activation in cold climates, there are the cases where generation of a discharge current delays and so the electrical discharge is not finished at the end of the pulse of the positive voltage Va and the negative voltage −Vy in the address interval so that there is high probability of an address error not allowing selection of a luminous cell and it is difficult to secure a stable operation margin.

The invention described in Patent Document 1 detects the panel temperature and changes the voltage of a scan pulse, and particularly applies a short-period pulse immediately before applying the base voltage in order to prevent unnecessary electrical discharge due to increase in the molecules in the gas in the case where the panel temperature rises or the panel is lit up for a long period of time. However, the technique described in Patent Document 1 cannot solve the problem in the case where the environment temperature of the plasma display becomes low.

The problem to be solved by the present invention is the problem that, in the case where the environment temperature of the plasma display is low, the generation of a discharge current delays and the probability of an address error becomes high so that it is difficult to secure a stable operation margin.

DISCLOSURE OF THE INVENTION

To solve the problem, a plasma display driving method and device of the present invention detects environment temperature of the plasma display, and exerts control so that, in a charge adjustment interval after a write interval within a reset interval, a drive waveform of a voltage applied to a scan electrode continuously changes in a negative direction and changes an ultimate voltage at the end of the charge adjustment interval according to the detected environment temperature. As for the direction of the change, the ultimate voltage is put in a positive direction when environment temperature becomes low.

To be more precise, the plasma display driving method and device of the present invention set multiple ultimate voltages, change inclination of the drive waveform or control a change in timing of the end of the charge adjustment interval according to the detected environment temperature so that the ultimate voltage is put in the positive direction when the environment temperature becomes low.

According to the present invention, it is possible, in the case where the environment temperature of the plasma display is low, to curb a delay of generation of a discharge current, lower probability of an address error and secure a stable operation margin so as to prevent deterioration of display image quality of the plasma display in the case where the environment temperature is low.

BRIEF DESCRIPTION OF THE DRAWINGS

FIG. 4 are diagrams showing the drive waveform applied to a Y driving circuit and the Y electrode and timing of switching of each switch as to the plasma display panel according to the first embodiment of the present invention;

FIG. 6 are diagrams showing the drive waveform applied to the Y driving circuit and the Y electrode and the timing of switching of each switch as to the plasma display panel according to the second embodiment of the present invention;

FIG. 10 are diagrams showing a structure of the conventional plasma display panel and a subfield configuration of a driving signal;

FIG. 13 are diagrams showing the drive waveform applied to the Y driving circuit and the Y electrode and the timing of switching of each switch as to the conventional plasma display panel;

FIG. 14 are a schematic diagram of the panel and the driving circuit and a diagram showing the drive waveform applied to each of the electrodes as to the plasma display device of Patent Document 1.

DESCRIPTION OF SYMBOLS

Figure 1:
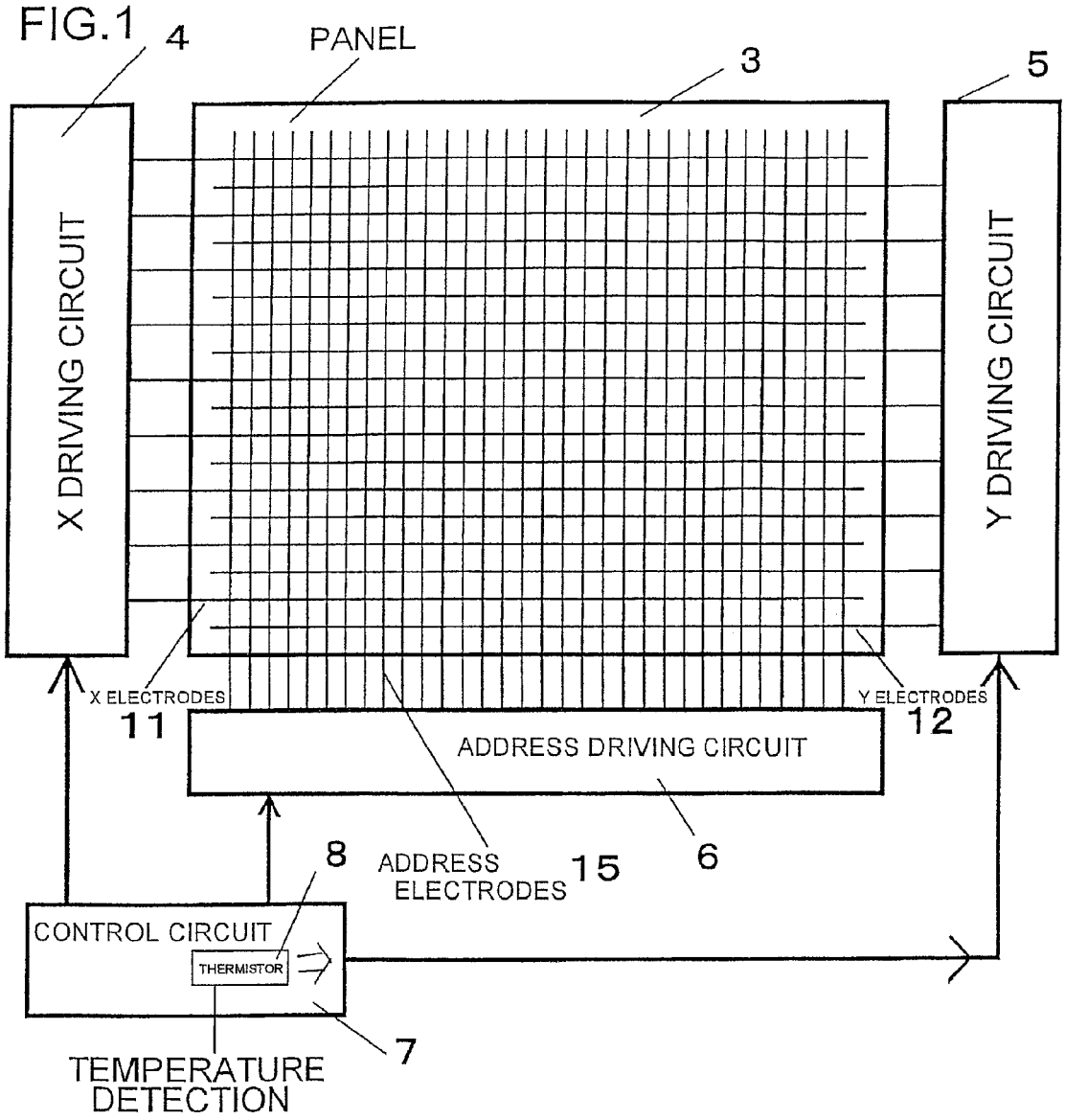
FIG. 1 is a schematic diagram of a panel and a driving circuit of a plasma display device according to the present invention.

1 Front plate
2 Backplane
3 Panel
4 X driving circuit
5 Y driving circuit
6 Address driving circuit
7 Control circuit
8 Thermistor
11 X electrode
12 Y electrode
13, 16 Dielectric layers
14 Protective layer
15 Address electrode
17 Bulkhead
18 to 20 Phosphors
21 to 30 Subfields
31 Reset interval
32 Address interval
33 Sustain interval

BEST MODE FOR CARRYING OUT THE INVENTION

FIG. 1 shows a schematic diagram of a panel and a driving circuit of a plasma display device according to the present invention.

With reference to FIG. 1, the plasma display device of the present invention is composed of a plasma display panel 3, an X driving circuit 4, a Y driving circuit 5, an address driving circuit 6 and a control circuit 7. In comparison with a conventional plasma display device, the plasma display device of the present invention includes temperature detection means 8, such as a thermistor. The plasma display device of the present invention is characterized in that a control signal generated according to detected environment temperature is transmitted from the control circuit 7 to the X driving circuit 4, the address driving circuit 6 and the Y driving circuit 5, and a drive waveform of a voltage applied to each of the electrodes according to the environment temperature is generated by the control signal.

In FIG. 1, the thermistor 8 as the temperature detection means is placed inside the control circuit 7. However, it is not necessary to limit the position for placing the temperature detection means 8 which detects low environment temperature to inside of the control circuit 7 or inside of the panel.

Figure 2:
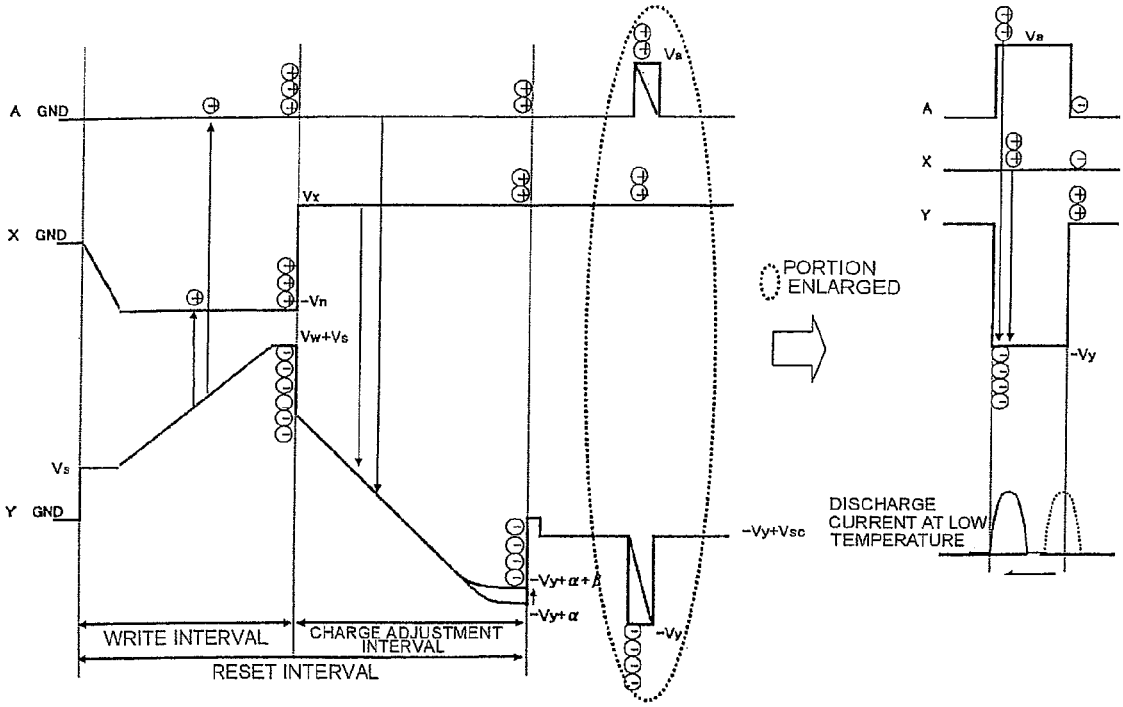
FIG. 2 are diagrams showing a drive waveform applied to a Y electrode and a solution of a problem in the case where the environment temperature is low as to a plasma display panel of the present invention.

FIG. 2 are diagrams showing a drive waveform applied to an address electrode, an X electrode and a Y electrode and a solution of the problem in the case where the environment temperature is low as to the plasma display panel of the present invention.

In FIG. 2, if there is a rise in the voltage of the drive waveform applied to the Y electrode in the write interval within the reset interval, negative charges accumulate in proximity to the Y electrode in the panel while positive charges accumulate in proximity to the address electrode and the X electrode. The accumulated negative charges and positive charges gradually decrease in the charge adjustment interval.

The present invention exerts control to change the drive waveform of the voltage applied to the Y electrode in the charge adjustment interval when environment temperature of the plasma display becomes low and change an ultimate voltage at the end of the charge adjustment interval from conventional $-Vy+\alpha$ to $-Vy+\alpha+\beta$ so as to put the change in the ultimate voltage in a positive direction.

The control secures an adequate amount of wall charges which accumulate negative charges in proximity to the Y electrode in the panel and positive charges in proximity to the address electrode and the X electrode at the end of the charge adjustment interval. In the address interval after the reset interval, if a positive voltage Va is applied to the address electrode and a negative voltage $-Vy$ is simultaneously applied to the Y electrode, a potential due to the wall charges and a potential difference $(Va+Vy)$ between the positive voltage Va and the negative voltage $-Vy$ in the address interval is overlapped. Thus, a discharge current is generated without delay, and an address discharge is finished with a stable operation margin between the address electrode and the Y electrode at the end of the pulse of the positive voltage Va and the negative voltage $-Vy$ of the address interval. Therefore, occurrence of an address error is curbed, and a high-quality image of the plasma display can be displayed even at low environment temperature.

Hereafter, embodiments of the present invention will be described using the drawings.

First Embodiment

Figure 3:
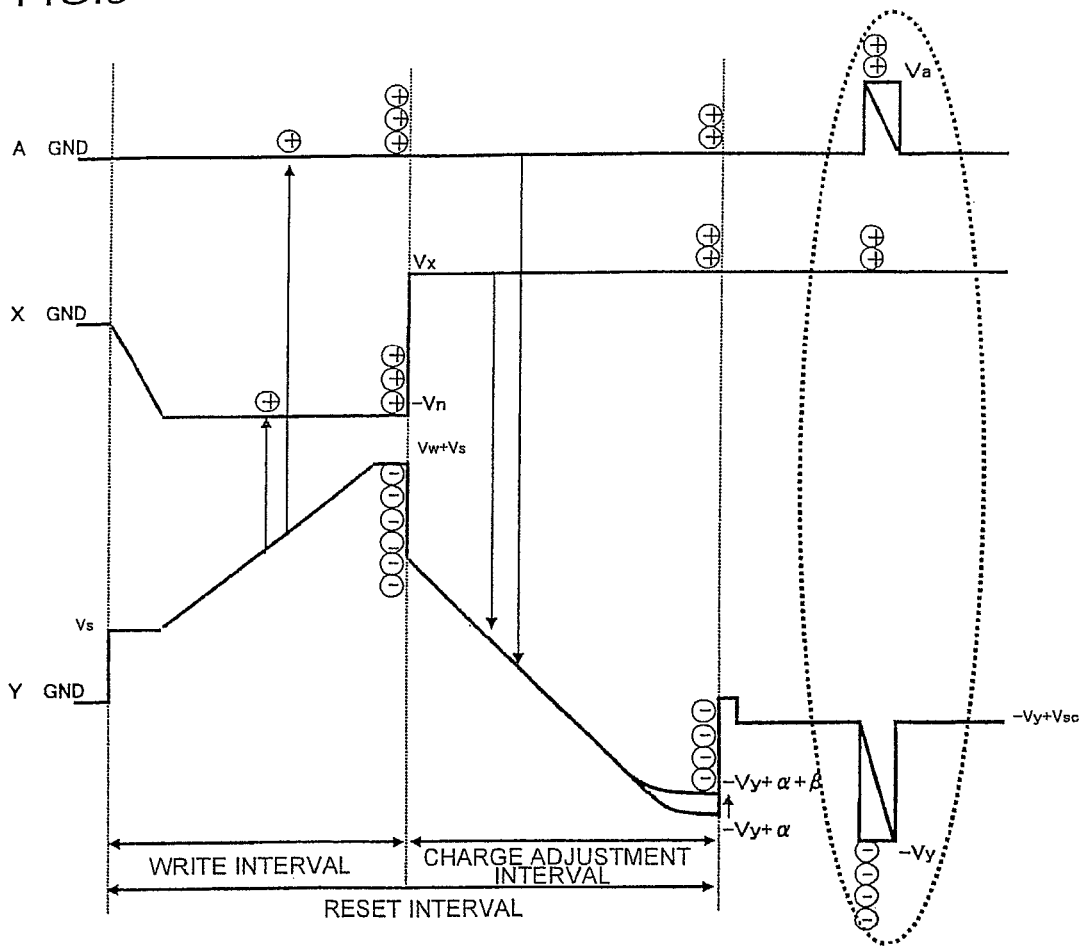
FIG. 3 is a diagram showing the drive waveform applied to each of the electrodes in the case of resetting all the cells in a write interval of a plasma display according to a first embodiment of the present invention.

FIG. 3 is a diagram showing the drive waveform applied to each of the electrodes in the case of resetting all the cells in a write interval of a plasma display according to a first embodiment of the present invention.

In FIG. 3, if there is a rise in the voltage of the drive waveform applied to the Y electrode in the write interval within the reset interval, the negative charges accumulate in proximity to the Y electrode in the panel while the positive charges accumulate in proximity to the address electrode and the X electrode. The accumulated negative charges and positive charges gradually decrease in the charge adjustment interval.

The first embodiment is characterized in that, when the environment temperature of the plasma display is low, control is exerted to change the ultimate voltage at the end of the charge adjustment interval from conventional $-Vy+\alpha$ to $-Vy+\alpha+\beta$ so as to put the change in the ultimate voltage in the positive direction.

In FIG. 3, the change in the ultimate voltage from $-Vy+\alpha$ to $-Vy+\alpha+\beta$ is made in two steps according to lowering of the environment temperature. It is also possible, however, to form the two steps in further multiple steps and thereby make a phased or linear change according to the change in the environment temperature.

FIG. 4 are diagrams showing the drive waveform applied to a Y driving circuit and the Y electrode and timing of switching of each switch as to the plasma display panel according to the first embodiment of the present invention.

The Y driving circuit of the first embodiment includes positive voltages Vs, Vw and negative voltages (−Vy+α), (−Vy), and is composed of multiple diodes, multiple inductances L, multiple capacitances C, multiple resistances R and multiple switches SW 1 to SW 14. The Y driving circuit controls the timing of switching (on/off: H, L) of the multiple switches SW 1 to SW 14 so as to apply the drive waveform of the Y electrode to a panel Cpanel. The Y driving circuit of the first embodiment is characterized by providing the negative voltage (−Vy+α+β) in parallel other than the negative voltage (−Vy+α) and also providing the SW 14 other than the SW 6 so as to control them by switching between the negative voltage (−Vy+α) and the negative voltage (−Vy+α+β) by means of the switches SW 6 and SW 14.

When operating at normal temperature, it is possible to set the ultimate voltage at the end of the charge adjustment interval at −Vy+α by turning the SW6 on and the SW14 off and change the ultimate voltage at the end of the charge adjustment interval to −Vy+α+β by turning the SW 6 off and SW 14 on.

It is desirable to set the ultimate voltage to be changed by the environment temperature at a scan voltage (−Vy) of the address interval or higher. (−Vy)<(−Vy+α)<(−Vy+α+β)

It is also desirable to set the potential difference between the ultimate voltage and the scan voltage within approximately 30 V.

$$(-Vy+\alpha+\beta)-(-Vy)=\alpha+\beta<30\text{ V}$$

In the case of changing the ultimate voltage as above, the drive waveform of the voltage applied to the Y electrode continuously changes in the negative direction within the charge adjustment interval. Thus, it is possible to accumulate sufficient wall charges in each of the electrodes in the panel and generate the discharge current without delay. The address discharge is finished with a stable operation margin between the address electrode and the Y electrode at the end of the pulse of the positive voltage Va and the negative voltage −Vy of the address interval. Therefore, occurrence of an address error is curbed, and a high-quality image of the plasma display can be displayed even at low environment temperature.

Second Embodiment

Figure 5:
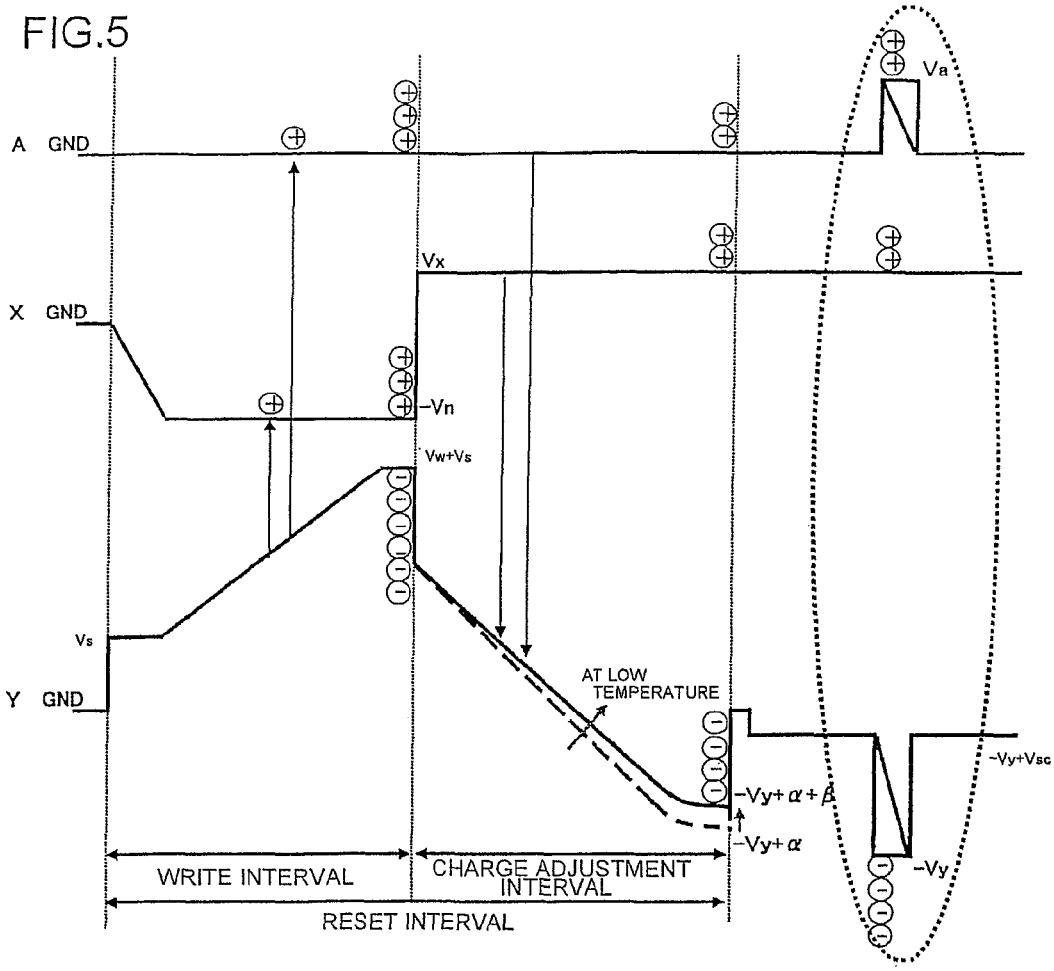
FIG. 5 is a diagram showing the drive waveform applied to each of the electrodes in the case of resetting all the cells in the write interval of the plasma display according to a second embodiment of the present invention.

FIG. 5 is a diagram showing the drive waveform applied to each of the electrodes in the case of resetting all the cells in the write interval of the plasma display according to a second embodiment of the present invention.

In FIG. 5, if there is a rise in the voltage of the drive waveform applied to the Y electrode in the write interval within the reset interval, the negative charges accumulate in proximity to the Y electrode in the panel while the positive charges accumulate in proximity to the address electrode and the X electrode. The accumulated negative charges and positive charges gradually decrease in the charge adjustment interval.

The second embodiment is characterized in that, when the environment temperature of the plasma display is low, control is exerted to change the inclination of the drive waveform applied to the Y electrode in the charge adjustment interval and change the ultimate voltage at the end from conventional −Vy+α to −Vy+α+β so as to put the change in the ultimate voltage in the positive direction.

FIG. 6 are diagrams showing the drive waveform applied to the Y driving circuit and the Y electrode and the timing of switching of each switch as to the plasma display panel according to the second embodiment of the present invention.

The Y driving circuit of the second embodiment described in FIG. 6 includes positive voltages Vs, Vw and negative voltages (−Vy+α), (−Vy), and is composed of multiple diodes, multiple inductances L, multiple capacitances C, multiple resistances R and multiple switches SW 1 to SW 14. The Y driving circuit controls the timing of switching (on/off: H, L) of the multiple switches SW 1 to SW 14 so as to apply the drive waveform of the Y electrode to the panel Cpanel. The Y driving circuit of the second embodiment is characterized by providing in parallel a resistance R2 of which resistance value is larger than that of a resistance R1 other than the resistance R1 connected to the negative low voltage (−Vy+α) and also providing the SW 14 other than the SW 6 so as to control them by switching between the R1 and the R2 by means of the switches SW 6 and SW 14.

When operating at normal temperature, the ultimate voltage becomes −Vy+α at the end of the charge adjustment interval by turning the SW6 on and the SW14 off. In the case where the environment temperature is low, the ultimate voltage at the end of the charge adjustment interval is changed to the positive direction by turning the SW6 off and the SW14 on and changing from the R1 to the R2 of a larger resistance value. For instance, it can be changed to −Vy+α+β.

In the case of changing the inclination of the drive waveform as above, the drive waveform of the voltage applied to the Y electrode continuously changes in the negative direction within the charge adjustment interval. Thus, it is possible to accumulate sufficient wall charges in each of the electrodes in the panel and generate the discharge current without delay. The address discharge is finished with a stable operation margin between the address electrode and the Y electrode at the end of the pulse of the positive voltage Va and the negative voltage −Vy of the address interval. Therefore, occurrence of an address error is curbed, and a high-quality image of the plasma display can be displayed even at low environment temperature.

Third Embodiment

Figure 7:
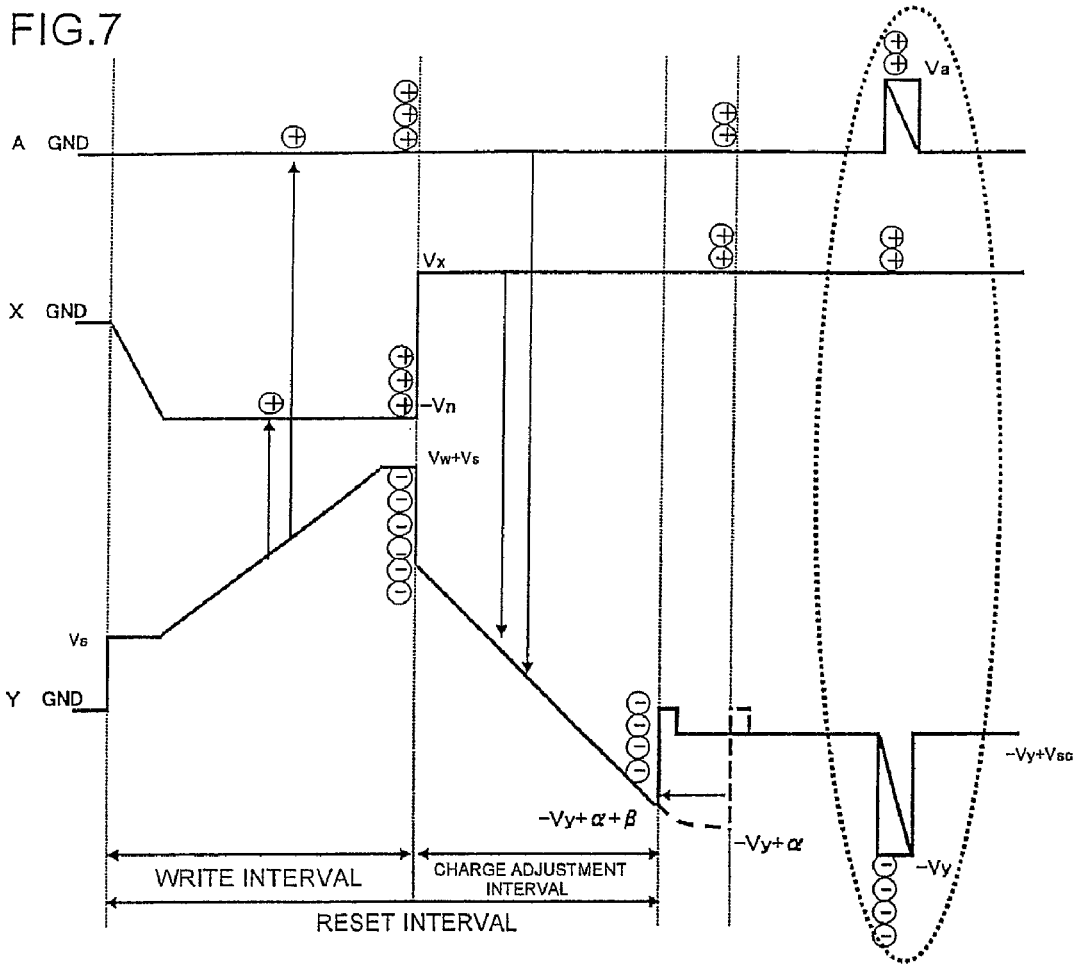
FIG. 7 is a diagram showing the drive waveform applied to each of the electrodes in the case of resetting all the cells in the write interval of the plasma display according to a third embodiment of the present invention.

FIG. 7 is a diagram showing the drive waveform applied to each of the electrodes in the case of resetting all the cells in the write interval of the plasma display according to a third embodiment of the present invention.

In FIG. 7, if there is a rise in the voltage of the drive waveform applied to the Y electrode in the write interval within the reset interval, the negative charges accumulate in proximity to the Y electrode in the panel while the positive charges accumulate in proximity to the address electrode and the X electrode. The accumulated negative charges and positive charges gradually decrease in the charge adjustment interval.

The third embodiment is characterized in that, when the environment temperature of the plasma display is low, control is exerted to change operation timing at the end of the charge adjustment interval and the ultimate voltage at the end changes from conventional −Vy+α to −Vy+α+β for instance so as to put the change in the ultimate voltage in the positive direction.

In the case of changing operation timing at the end of the charge adjustment interval as above, the drive waveform of the voltage applied to the Y electrode continuously changes in the negative direction within the charge adjustment interval. Thus, it is possible, at the end of −Vy+α+β high in the positive direction to accumulate sufficient wall charges in each of the electrodes in the panel and generate the discharge current without delay. The address discharge is finished with a stable operation margin between the address electrode and the Y electrode at the end of the pulse of the positive voltage Va and the negative voltage −Vy of the address interval. Therefore, occurrence of an address error is curbed, and a high-quality image of the plasma display can be displayed even at low environment temperature.

OTHER EMBODIMENT

Figure 8:
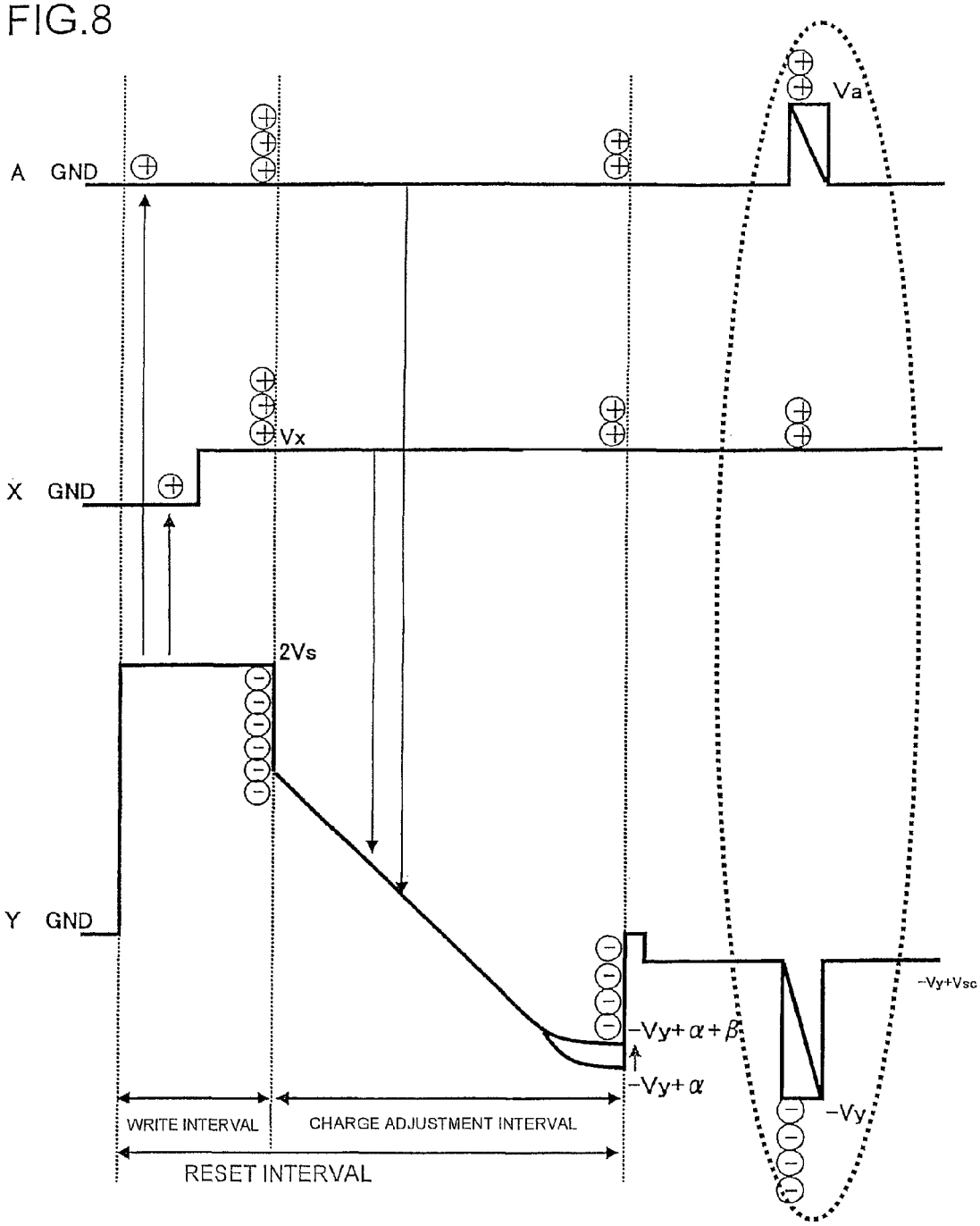
FIG. 8 is a diagram showing the drive waveform applied to each of the electrodes in the case of resetting only the cells lit up in the write interval within the reset interval according to another embodiment of the present invention.
Figure 9:
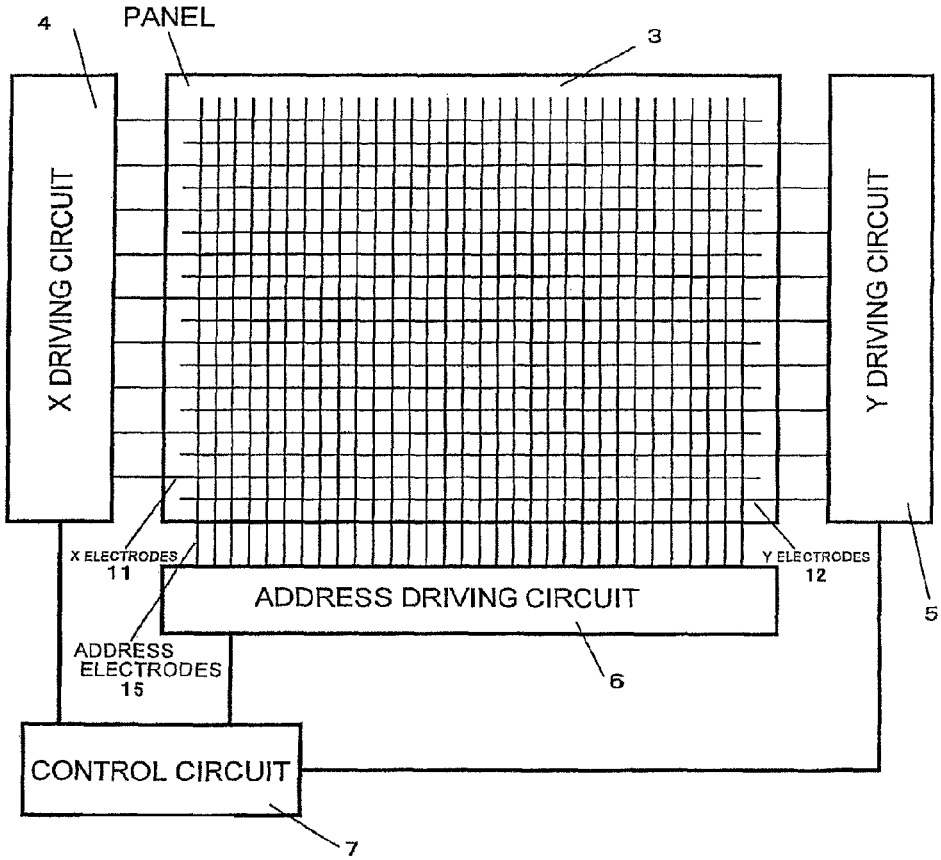
PRIOR ART FIG.9
FIG. 9 is a schematic diagram showing an overview of a panel and a driving circuit of a conventional plasma display device.
Figure 11:
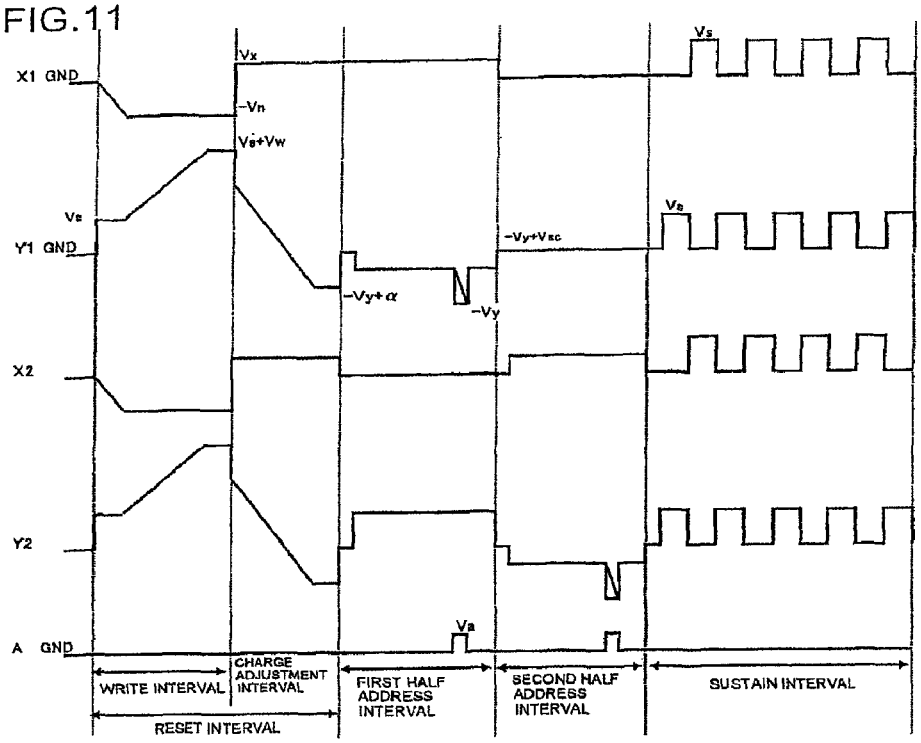
PRIOR ART FIG.11
FIG. 11 is a diagram showing the drive waveform applied to each of the electrodes in the case of resetting all the cells in the write interval within the reset interval of the conventional plasma display.
Figure 12:
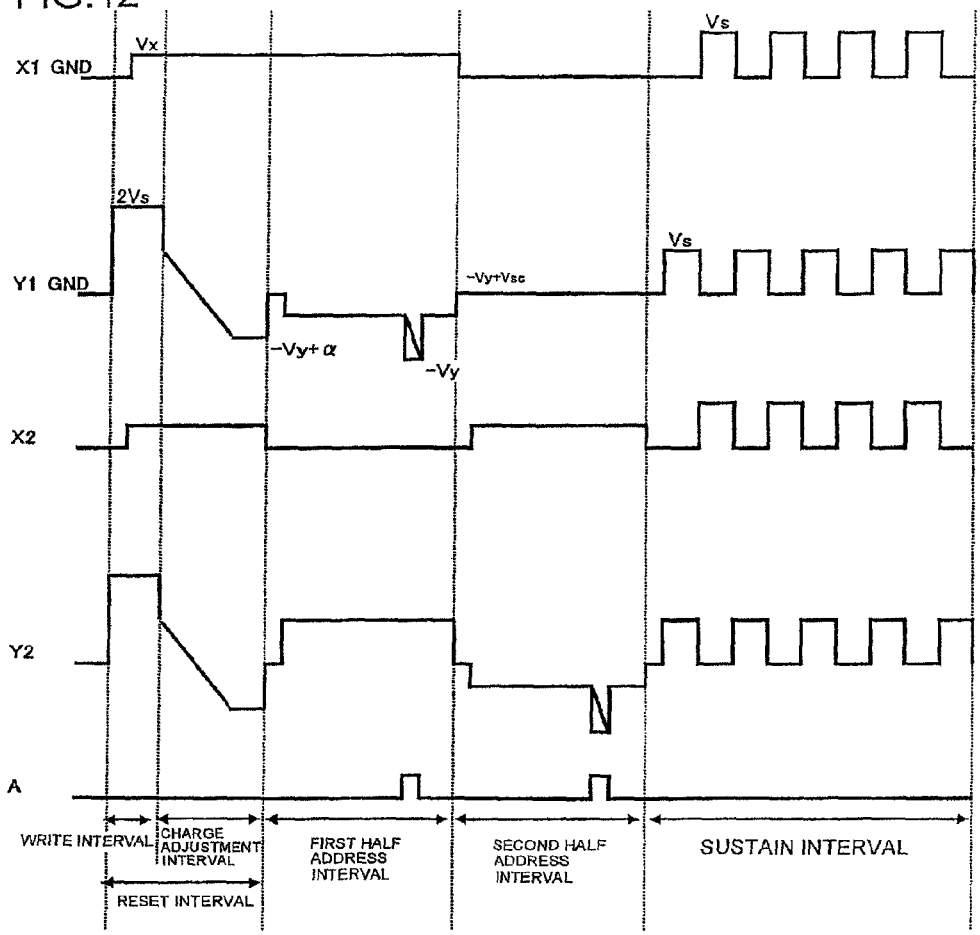
PRIOR ART FIG.12
FIG. 12 is a diagram showing the drive waveform applied to each of the electrodes in the case of resetting only the cells lit up in the write interval within the reset interval of the conventional plasma display.
Figure 15:
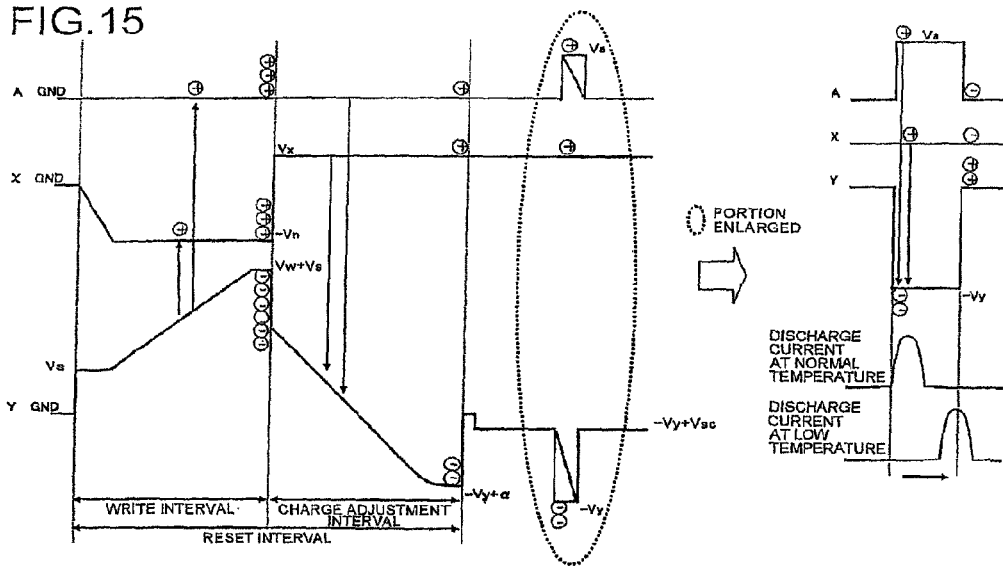
PRIOR ART FIG.15
FIG. 15 are diagrams showing the drive waveform applied to the Y electrode and a problem in the case where the environment temperature is low as to the conventional plasma display panel.

FIG. 8 is a diagram showing the drive waveform applied to each of the electrodes in the case of resetting only the cells lit up in the write interval within the reset interval according to another embodiment of the present invention.

As shown in FIG. 8, as for the drive waveform applied to each of the electrodes in the case of resetting only the cells lit up, the voltage of the drive waveform applied to the Y electrode rises to 2Vs at a start time of the write interval within the reset interval, and the voltage of the drive waveform applied to the X electrode rises to Vx halfway through the write interval. The negative charges accumulate in proximity to the Y electrode in the panel while the positive charges accumulate in proximity to the address electrode and the X electrode. The accumulated negative charges and positive charges gradually decrease in the charge adjustment interval.

The other embodiment is characterized in that, when the environment temperature of the plasma display is low, control is exerted to change the drive waveform of the voltage applied to the Y electrode in the charge adjustment interval and change the ultimate voltage at the end of the charge adjustment interval from conventional $-Vy+\alpha$ to $-Vy+\alpha+\beta$ so as to put the change in the ultimate voltage in the positive direction.

The control secures an adequate amount of the wall charges which accumulate the negative charges in proximity to the Y electrode in the panel and the positive charges in proximity to the address electrode and the X electrode at the end of the charge adjustment interval. In the address interval after the reset interval, if the positive voltage Va is applied to the address electrode and the negative voltage −Vy is simultaneously applied to the Y electrode, a potential due to the wall charges and a potential difference (Va+Vy) between the positive voltage Va and the negative voltage −Vy in the address interval are overlapped. Thus, the discharge current is generated without delay, and the address discharge is finished with a stable operation margin between the address electrode and the Y electrode at the end of the pulse of the positive voltage Va and the negative voltage −Vy of the address interval. Therefore, occurrence of an address error is curbed, and a high-quality image of the plasma display can be displayed even at low environment temperature.

According to the other embodiment, it is possible to combine the methods of selecting multiple ultimate voltages, changing the inclination of the drive waveform and changing the timing at the end of the charge adjustment interval described in the first to third embodiments as a method of changing the drive waveform applied to the Y electrode and the ultimate voltage during the charge adjustment interval.

The invention claimed is:

1. A driving method of a plasma display having multiple parallel first and second electrodes mutually and adjacently placed with respect to each other, multiple third electrodes placed to intersect with the first and second electrodes, a discharge cell prescribed in a cross region of each of the electrodes, and including a reset interval, an address interval and a sustained discharge interval the method comprising the steps of:

in the reset interval, applying a positive pulse to the second electrode, and then applying slope waveform which decreases an applied voltage value over time to the second electrode;

detecting environment temperature of the plasma display; and raising an ultimate raising a reached potential of the slope waveform by decreasing an inclination thereof in accordance with a voltage change value per unit time when the environment temperature falls, and lowering the reached potential of the slope waveform by increasing the inclination thereof when the environment temperature rises.

2. The driving method of a plasma display according to claim 1, wherein the reached potential of the slope waveform is higher than a negative voltage which is applied to the second electrode during the address interval even though the environment temperature rises.

3. The driving method of a plasma display according to claim 1, wherein the slope waveform sustains the reached potential for a predetermined interval when arriving at the reached potential.

4. The driving method of a plasma display according to claim 3, wherein a fixed voltage having a different voltage value is applied to the each of the first and third electrodes during an applied interval of the slope waveform.

5. The driving method of a plasma display according to claim 4, wherein the positive pulse is a pulse which increases an applied voltage value over time, a negative fixed voltage is applied to the first electrode during an applied interval of the positive pulse to the second electrode, and a positive fixed voltage is applied to the first electrode during an applied interval of the slope waveform.

* * * * *